US006819335B2

(12) United States Patent
Naganuma

(10) Patent No.: US 6,819,335 B2
(45) Date of Patent: Nov. 16, 2004

(54) NUMBER-OF-GRADATION-LEVELS DECREASING METHOD, IMAGE DISPLAYING METHOD, AND IMAGE DISPLAY

(75) Inventor: Tatumi Naganuma, Nagano (JP)

(73) Assignee: Totoku Electric Co., Ltd., Tokyo (JP)

( * ) Notice: Subject to any disclaimer, the term of this patent is extended or adjusted under 35 U.S.C. 154(b) by 27 days.

(21) Appl. No.: 10/296,694

(22) PCT Filed: May 11, 2001

(86) PCT No.: PCT/JP01/03924

§ 371 (c)(1),
(2), (4) Date: Nov. 26, 2002

(87) PCT Pub. No.: WO01/93239

PCT Pub. Date: Dec. 6, 2001

(65) Prior Publication Data

US 2003/0137478 A1 Jul. 24, 2003

(30) Foreign Application Priority Data

May 31, 2000 (JP) ..... 2000-162625

(51) Int. Cl.[7] ..... G09G 5/10
(52) U.S. Cl. ..... 345/692; 345/89; 349/17
(58) Field of Search ..... 315/169.1, 169.3; 345/60, 691, 692, 88, 98, 201, 63, 89; 358/3.01; 349/17, 36, 41

(56) References Cited

U.S. PATENT DOCUMENTS 5,691,745 A * 11/1997 Mital ..... 345/692
6,061,049 A * 5/2000 Pettitt et al. ..... 345/691
6,151,011 A * 11/2000 Worley et al. ..... 345/692
6,288,714 B2 * 9/2001 Yamamoto et al. ..... 345/60
6,614,557 B1 * 9/2003 Lu et al. ..... 358/3.01

* cited by examiner

*Primary Examiner*—Wilson Lee
(74) *Attorney, Agent, or Firm*—Jordan and Hamburg LLP

(57) ABSTRACT

A liquid crystal display 200 comprises a 1024-to-1021 gray scale conversion calculator 1 for converting an image data $A_{(1024)}$ of 1024 gray levels (=10 bits) into an image data $Y_{(1021)}$ of 1021 gray levels, an adjusting four-level sample storage 22 and a random number generator circuit 3 for randomly selecting and releasing on the frame-by-frame basis a group of the adjusting four gray levels Δ1p to Δ4p, Δ1q to Δ4q, and Δ1r to Δ4r which is determined by the least two bits $Y_{(1021_d2)}$ of the image data $Y_{(1021)}$ of 1021 gray levels at each of segments (p,q,r) of one pixel, an adder 23 for summing the upper eight bits $Y_{(1021_{13}\ d8)}$ of the image data $Y_{(1021)}$ of 1021 gray levels and one group of the adjusting four gray levels to have three sets of image data of 256 gray levels D1p to D4p, D1q to D4q, and D1r to D4r which are then released in a sequence, and a 256 gray scale three-segment monochrome liquid crystal display panel 24. As the result, the apparatus needs no gray scale conversion table and can be minimized in the overall cost. Also, the image of which the number of gray levels is greater than that of a display panel can speciously be reproduced with explicitness.

6 Claims, 6 Drawing Sheets

| hexadecimal | image data of 1024 gray levels $A_{(1024)}$ | $a_9 \times 2^1 + a_8 \times 2^0$ | image data of 1021 gray levels $Y_{(1021)}$ |
|---|---|---|---|
| 0～FF … | 0～255 | 0 | $A_{(1024)} - 0$ |
| 100～1FF … | 256～511 | 1 | $A_{(1024)} - 1$ |
| 200～2FF … | 512～767 | 2 | $A_{(1024)} - 2$ |
| 300～3FF … | 768～1023 | 3 | $A_{(1024)} - 3$ |

256 gray scale image data sample strorage

2

| image data of 1021 gray levels Y (1021) \ random number N | 256 gray scale image data samples | | | |
|---|---|---|---|---|
| | 0 0 | 0 1 | 1 0 | 1 1 |
| 0 0 0 0 0 0 0 0 0 0 | 0 0 0 0 0 0 0 0 | 0 0 0 0 0 0 0 0 | 0 0 0 0 0 0 0 0 | 0 0 0 0 0 0 0 0 |
| 0 0 0 0 0 0 0 0 0 1 | 0 0 0 0 0 0 0 1 | 0 0 0 0 0 0 0 0 | 0 0 0 0 0 0 0 0 | 0 0 0 0 0 0 0 0 |
| 0 0 0 0 0 0 0 0 1 0 | 0 0 0 0 0 0 0 1 | 0 0 0 0 0 0 0 1 | 0 0 0 0 0 0 0 0 | 0 0 0 0 0 0 0 0 |
| 0 0 0 0 0 0 0 0 1 1 | 0 0 0 0 0 0 0 1 | 0 0 0 0 0 0 0 1 | 0 0 0 0 0 0 0 1 | 0 0 0 0 0 0 0 0 |
| ⋮ | ⋮ | ⋮ | ⋮ | ⋮ |
| 1 1 1 1 1 1 1 1 0 0 | 1 1 1 1 1 1 1 1 | 1 1 1 1 1 1 1 1 | 1 1 1 1 1 1 1 1 | 1 1 1 1 1 1 1 1 |
| decimal ··· 0 ~ 1 0 2 0 | 0 ~ 2 5 5 | 0 ~ 2 5 5 | 0 ~ 2 5 5 | 0 ~ 2 5 5 |

total 0 ~ 1 0 2 0

Fig. 7 adjusting four gray level sample storage

22

| random number N / segment / least two bits | adjusting four gray level sample | | | | | | | | | | | |
|---|---|---|---|---|---|---|---|---|---|---|---|---|
| | 00 | | | 01 | | | 10 | | | 11 | | |
| | p | q | r | p | q | r | p | q | r | p | q | r |
| 00 | 0 | 0 | 0 | 0 | 0 | 0 | 0 | 0 | 0 | 0 | 0 | 0 |
| 01 | 0 | 0 | 1 | 0 | 1 | 0 | 1 | 0 | 0 | 0 | 0 | 0 |
| 10 | 1 | 0 | 1 | 0 | 1 | 0 | 1 | 1 | 0 | 0 | 0 | 1 |
| 11 | 1 | 1 | 0 | 1 | 0 | 1 | 0 | 1 | 1 | 1 | 1 | 1 |

Fig. 8

| segment / frame | p | q | r | p | q | r | p | q | r | p | q | r |
|---|---|---|---|---|---|---|---|---|---|---|---|---|
| frame F1 (D1p,D1q,D1r) | 64 | 64 | 64 | 65 | 64 | 64 | 65 | 65 | 64 | 65 | 65 | 65 |
| frame F2 (D2p,D2q,D2r) | 64 | 64 | 64 | 64 | 65 | 64 | 65 | 64 | 65 | 65 | 65 | 64 |
| frame F3 (D3p,D3q,D3r) | 64 | 64 | 64 | 64 | 64 | 65 | 64 | 64 | 65 | 64 | 65 | 65 |
| frame F4 (D4p,D4q,D4r) | 64 | 64 | 64 | 64 | 64 | 64 | 65 | 64 | 64 | 65 | 65 | 64 |
| gray level (1021 gray levels) | 256 (=64×4+0) | | | 257 (=64×4+1) | | | 258 (=64×4+2) | | | 259 (=64×4+3) | | |

1024-to-1021 gray scale conversion table
51

| decimal | image data of 1024 gray levels $A_{(1024)}$ | image data of 1021 gray levels $Y_{(1021)}$ | decimal |
|---|---|---|---|
| 0 | 0000000000 | 0000000000 | 0 |
| 1 | 0000000001 | 0000000001 | … 1 |
| 2 … | 0000000010 | 0000000010 | … 2 |
| 3 | 0000000011 | 0000000011 | … 3 |
| | ⋮ | ⋮ | |
| 1023 … | 1111111111 | 1111111100 | … 1020 |

NUMBER-OF-GRADATION-LEVELS DECREASING METHOD, IMAGE DISPLAYING METHOD, AND IMAGE DISPLAY

FIELD OF THE INVENTION

The present invention relates to a gray scale reducing method, an image displaying method, and an image displaying apparatus. More specifically, it relates to a gray scale reducing method for favorably reducing the number of gray levels with no use of a gray scale conversion table and to a method and an apparatus for speciously reproducing a fine image of which the number of gray levels is greater than that of a display panel.

BACKGROUND OF THE INVENTION

FIG. 9 is a block diagram of a conventional liquid crystal display.

The liquid crystal display 500 comprises a 1024-to-1021 gray scale conversion table 51 for converting an image data $A_{(1024)}$ of 1024 gray levels (=10 bits) received from, e.g., a computer (not shown) into an image data $Y_{(1021)}$ of 1021 gray levels, a 256 gray scale image data sample storage 2 where image data samples of 256 gray levels are stored as sets of four different 256 gray scale images (=8 bits) for speciously reproducing an image of 1021 gray levels, a random number generator circuit 3 for generating a random number N to select and release a set of image data D1 to D4 of 256 gray levels at each four frames in response to the image data $Y_{(1021)}$ of 1021 gray levels received from the 256 gray scale image data sample storage 2, and a 256 gray scale monochrome liquid crystal display panel 4 for displaying images of 256 gray levels determined by the 256 gray scale image data D1 to D4. The image to be reproduced shall be a monochrome image.

FIG. 10 is a diagram showing an arrangement of the 1024-to-1021 gray scale conversion table 51.

The image data $A_{(1024)}$ of 1024 gray levels stored at the (left) entry column consists of a binary 10-bit value ranging from "0000000000" and "0000000001", to "1111111111" equivalent from 0 to 1023 (of the decimal notation).

The image data $Y_{(1021)}$ of 1021 gray levels at the (right) entry column consists of a binary 10-bit value which corresponds to a 1024 gray scale image ranging from 0 to 1020 (of the decimal notation). As the gray levels are reduced by three, three entries of the 10-bit value are overlapped in the storage.

FIG. 11 is an explanatory view showing the principle of speciously reproducing an image of 1021 gray levels with the use of four frames of 256 gray levels.

It is assumed that the frames F1, F2, F3, and F4 are displayed at short intervals of 1/60 the second and their gray level of 256 gray scale at a given pixel is varied from L1, L2, and L3 to L4. The gray level at the pixel is apparently equal to a level (L1+L2+L3+L4) of the 1021 (=2255×4+1) gray scale. When L1=63, L2=63, L3=63, and L4=64, the level 253 of the 1021 gray scale can speciously be reproduced. This technique for reproducing an intermediate tone with the use of a series of frames is known as interframe error diffusion or Frame Rate Control.

Accordingly, as each set of the four different image data samples of 256 gray levels stored in the 256 gray scale image data sample storage 2 (FIG. 4) are equal to an image data $Y_{(1021)}$ of 1021 gray levels, they can speciously be reproduced as a 1021 gray scale mono chrome image.

The random number N provided for selection of a set of the 256 gray scale image data samples is intended to minimize the generation of "flicker" and stripe noises which are derived from the regularity of a change in the grays level at each frame.

The conventional liquid crystal display 500 requires a memory for storage of 10 kilobits (=1024×10 bits) as the 1024-to-1021 gray scale conversion table 51 and will thus be increased in the overall cost.

Also, if the random number N is low in the accuracy (i.e. a particular pattern appears at very short intervals and its value is repeated at high frequency), the effect of "flicker" and stripe noises may increase thus allowing an observer to have an abnormal impression.

It is hence a first object of the present invention to provide a gray scale reducing method for favorably reducing the number of gray levels with no use of a gray scale conversion table.

It is a second object of the present invention to provide a method and an apparatus for speciously reproducing a fine image of which the number of gray levels is greater than that of a display panel.

SUMMARY OF THE INVENTION

As a first aspect of the present invention, a gray scale reducing method is provided comprising a step of converting a bit stream input $(a_{\alpha-1}, a_{\alpha-2}, a_{\alpha-3}, \ldots, a_0)$ of $2^\alpha$ gray levels expressed by $A=_{\alpha-1}\times 2^{\alpha-1}+a_{\alpha-2}2\times 2^{\alpha-2}+a_{\alpha-3}\times 2^{\alpha-3}+\ldots+a_0\times 2^0[\alpha\geqq 2]$ into a bit stream output of $(2^\alpha-2^{\alpha-\beta}+1)$ gray levels expressed by $Y=a_{\alpha-1}\times 2^{\alpha-1}+a_{\alpha-2}\times 2^{\alpha-2}+a_{\alpha-3}\times 2^{\alpha-3}+\ldots+a_0\times 2^0-(a_{\alpha-1}\times 2^{\alpha-\beta-1}+a_{\alpha-2}\times 2^{\alpha-\beta-2}+\ldots+a_\beta\times 2^0)$ $[\alpha>\beta\geqq 1]$.

The gray scale reducing method of the first aspect enables a simple arithmetic operation of subtracting the upper $(\alpha-\beta)$ bits from the input A of $2^\alpha$ gray levels as a bit stream $(a_{\alpha-1}, a_{\alpha-2}, a_{\alpha-3}, \ldots, a_0)$ to determine a bit stream output Y of $(2^\alpha-2^{\alpha-\beta}+1)$ gray levels with no use of any gray scale conversion table. Since the inputs A to be converted into the identical output Y are equally dispersed at $2^{\alpha-\beta}-1$ different locations, its conversion can be prevented from biasing and thus improved in the accuracy. More particularly, when $\alpha=10$ and $\beta=8$, a bit stream of 1024 $(=2^{10})$ gray levels can accurately be converted into a bit stream of 1021 $(=2^{10}-2^{10-8}+1)$ gray levels.

As a second aspect of the present invention, an image displaying method is provided comprising steps of converting an image data by the gray scale reducing method of the first aspect from a bit stream of $2^\alpha$ gray levels to a bit stream of $(2^\alpha-2^{\alpha-\beta}+1)$ gray levels, and speciously reproducing by interframe error diffusion a fine image of which the gray level is equal to that of the converted bit stream.

The image displaying method of the second aspect enables to speciously reproduce by interframe error diffusion an image of which the number of gray levels is favorably reduced by the gray scale reducing method of the first aspect.

As a third aspect of the present invention, an image displaying method is provided comprising a step of controlling the gray level in each of m segments $(m\geqq 2)$ of one pixel on the frame-by-frame basis to speciously reproduce with the use of plural frames an image of which the number of gray levels is greater than that of a display panel which is capable of varying the gray level in each segment.

The image displaying method of the third aspect enables to change the gray level at each segment of a single pixel for spatially modulating the luminance of the pixel in one frame, thus displaying the number of gray levels of the pixel which is greater than that of the segments. More particularly, when one pixel consists of three segments, the gray level in one or two of the three segments can be declined to be lower by one step than that of the other segments or segment to reproduce an intermediate tone at steps of ⅓ the gray level. Accordingly, during the process of interframe error diffusion to speciously reproduce an image of which the number of gray levels is increased, the gray level of each pixel can be minimized in the difference between frames hence significantly attenuating the generation of "flicker" and stripe noises in the image.

As a fourth aspect of the present invention, an image displaying apparatus is provided comprising a gray scale reducing means for converting a bit stream ($a_{\alpha-1}$, $a_{\alpha-2}$, $a_{\alpha-3}$, . . . , $a_0$) of $2^\alpha$ gray levels of image data expressed by $A=_{\alpha-1}\times 2^{\alpha-1}+a_{\alpha-2}\times 2^{\alpha-2}+a_{\alpha-3}\times 2^{\alpha-3}+\ldots+a_0\times 2^0[a\geqq 2]$ into a bit stream of $(2^\alpha-2^{\alpha-\beta}+1)$ gray levels of image data expressed by $Y=a_{\alpha-1}\times 2^{\alpha-1}+a_{\alpha-2}\times 2^{\alpha-2}+a_{\alpha-3}\times 2^{\alpha-3}+\ldots+a_0\times 2^0-(a_{\alpha-1}\times 2^{\alpha-\beta-1}+a_{\alpha-2}\times 2^{\alpha-\beta-2}+\ldots+a_\beta\times 2^0)[\alpha>\beta\geqq 1]$, a displaying panel of which the number of gray levels for reproducing each frame of the image on a pixel-by-pixel basis is smaller than $2^\alpha$, and an image display controlling means for displaying on the display panel a series of images which have speciously been reproduced by interframe error diffusion and have corresponding gray levels determined by the converted bit streams.

The image displaying apparatus of the fourth aspect allows the image displaying method of the second aspect to be satisfactorily performed.

As a fifth aspect of the present invention, an image displaying apparatus is provided comprising a displaying panel which is capable of varying the gray level in each of m segments ($m\geqq 2$) of one pixel, and an image display controlling means for controlling the gray level of each segment on the frame-by-frame basis to speciously reproduce an image of which the number of gray levels is greater than that applicable in the segment at each frame.

The image displaying apparatus of the fifth aspect allows the image displaying method of the third aspect to be satisfactorily performed.

As a sixth aspect of the present invention, an image displaying apparatus is provided comprising a gray scale reducing means for converting a bit stream ($a_{\alpha-1}$, $a_{\alpha-2}$, $a_{\alpha-3}$, . . . , $a_0$) of $2^\alpha$ gray levels of image data expressed by $A=a_{\alpha-1}\times 2^{\alpha-1}+a_{\alpha-2}\times 2^{\alpha-2}+a_{\alpha-3}\times 2^{\alpha-3}+\ldots+a_0\times 2^0[\alpha\geqq 2]$ into a bit stream of $(2^\alpha-2^{\alpha-\beta}+1)$ gray levels of image data expressed by $Y=a_{\alpha-1}\times 2^{\alpha-1}+a_{\alpha-2}\times 2^{\alpha-2}+a_{\alpha-3}\times 2^{\alpha-3}+\ldots+a_0\times 2^0-(a_{\alpha-1}\times 2^{\alpha-\beta-1}+a_{\alpha-2}\times 2^{\alpha-\beta-2}+\ldots+a_\beta\times 2^0)[\alpha>\beta\geqq 1]$, a displaying panel for reproducing $2^\beta$ gray levels in each of m segments ($m\geqq 2$) of one pixel, a gray level calculating means for sunning the upper β bits of the converted bit stream and an adjusting gray level predetermined for each segment by the lower (α−β) bits of the bit stream to determine the gray level in the segment at each of frames to be subjected to interframe error diffusion, and an image display controlling means for controlling the gray level in the segment of the display panel on the frame-by-frame basis.

The image displaying apparatus of the sixth aspect enables to change the gray level at each segment of a single pixel, hence minimizing the different in the gray level of the pixel between frames and significantly attenuating the generation of "flicker" and stripe noises in the image.

Also, the gray level of each segment of the frames can favorably be calculated by assigning a gray level of the upper β bits of the bit stream of $(2^\alpha-2^{\alpha-\beta}1)$ gray levels determined by the gray scale reducing method of the first aspect to the segment as the basic gray level in common with the segment of each of pixels at the frames to be subjected to interframe error diffusion and adding with an adjusting gray level predetermined and assigned to the lower (α−β) bits. This can requires a less storage capacity of the gray level data as compared with preliminary storage of all the $(2^\alpha-2^{\alpha-\beta}+1)$ gray levels of each segment, thus contributing the reduction of the overall cost.

As a seventh aspect of the present invention, the image displaying apparatus of the sixth aspect is modified further comprising an adjusting gray level sample storing means for saving samples of the adjusting gray level predetermined and assigned to each segment so that the average of gray levels of each pixel at the $2^{\alpha-\beta}$ frames for the error diffusion calculated by the gray scale reducing means is the upper β bits plus the least (α−β) bits/$2^{\alpha-\beta}$, and a randomly selecting and releasing means for randomly selecting and releasing any of the samples of the adjusting gray level on the frame-by-frame basis.

The image displaying apparatus of the seventh aspect enables to randomly select and release on the frame-by-frame basis a sample of the adjusting gray levels assigned to the segments so that the average gray level of each pixel in $2^{\alpha-\beta}$ error diffusion frames is equal to the upper β bits plus {the lower (α−β) bits/$2^{\alpha-\beta}$}, thus allowing each frame of the image of which the gray level is very close to the average gray level to be reproduced in case that a number of the error diffusion frames are aligned along the time base. The random selection is intended for minimizing the generation of "flicker" and stripe noises derived from the regularity of changes in the gray level of each segment.

More particularly, when α=10 and β=8, the average gray level of each pixel in four of the error diffusion frames is equal to a sum of 256 gray levels expressed by the upper eight bits of a bit stream of 1021 gray levels and four gray levels expressed by the lower two bits/4 and can hence be favored to speciously reproduce an image of 1021 gray levels.

As an eighth aspect of the present invention, the image displaying apparatus of any of the fourth to seventh aspects is modified wherein the display panel is a monochrome liquid crystal display panel.

The image displaying apparatus of the eighth aspect enables to display an image on the monochrome liquid crystal display and can thus be favored to speciously reproduce a monochrome image of multiple gray levels through interframe error diffusion.

BRIEF DESCRIPTION OF THE DRAWINGS

FIG. 7 is a table diagram showing an arrangement of an adjusting four-level sample storage;

FIG. 8 is a table diagram showing an image data of 256 gray levels at each segment of the liquid crystal display apparatus shown in FIG. 5;

BEST MODES FOR EMBODYING THE INVENTION

Figures 1, 2:
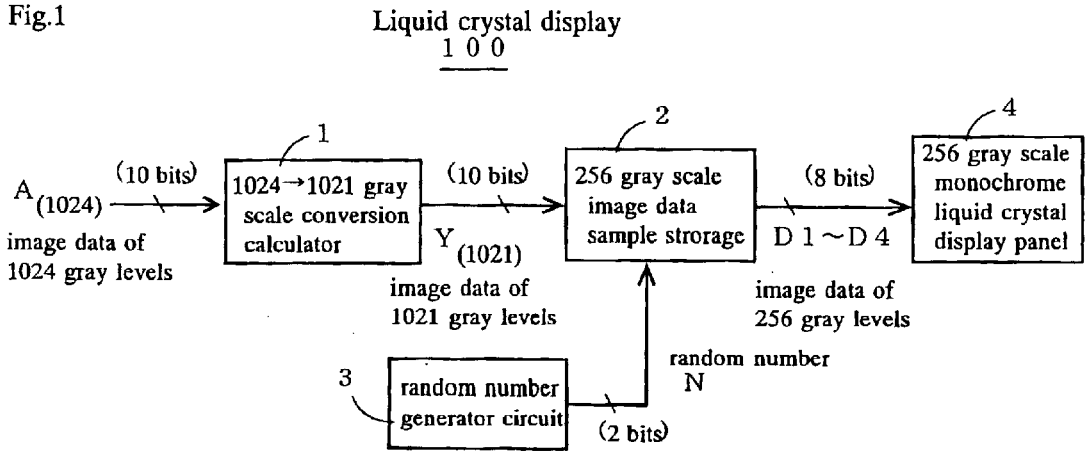
FIG. 1 is a block diagram of a liquid crystal display apparatus showing a first embodiment of the present invention.
FIG. 2 is a table diagram showing the relationship between image data $A_{(1024)}$ of 1024 gray levels and image data $Y_{(1021)}$ of 1021 gray levels.

The present invention will be describe d in more detail in conjunction with some embodiments illustrated in their relevant drawings. The present invention is not limited to the First Embodiment FIG. 1 is a block diagram of a liquid crystal display showing the first embodiment of the present invention.

The liquid crystal display 100 comprises a 1024-to-1021 gray scale conversion calculator 1 for converting an image data $A_{(1024)}$ of 1024 gray levels (=10 bits) received from, e.g., a computer (not shown) into an image data $Y_{(1021)}$ of 1021 gray levels, a 256 gray scale image data sample storage 2 where image data samples of 256 gray levels are stored as sets of four different 256 gray scale images (=8 bits) for speciously reproducing an image of 1021 gray levels, a random number generator circuit 3 for deter mining a random number N (two bits) to select and release a set of image data D1 to D4 of 256 gray levels at each four frames in response to the image data $Y_{(1021)}$ of 1021 gray levels received from the 256 gray scale image data sample storage 2, and a 256 gray scale monochrome liquid crystal display panel 4 for displaying images of 256 gray levels determined by the 256 gray scale image data D1 to D4. The image to be reproduced shall be a monochrome image.

The 1024-to-1021 gray scale conversion calculator 1 converts a stream of 1024 ($=2^{10}$) gray scale bits ($a_9$, $a_8$, $a_7$, . . . , $a_0$) which represent an image data of 1024 gray levels denoted by $a_9\times2^9+a_8\times2^8+a_7\times2^7+\ldots+a_0\times2^0$ into a stream of 1021 ($=2^{10}-2^{10-8}+1$) gray scale bits which represent an image data of 1021 gray levels denoted by $a_9\times2^9+a_8\times2^8+a_7\times2^7+\ldots+a_0\times2^0-(a_9\times2^1+a_8\times2^0)$. More specifically, its output is equal to the stream of 1024 gray scale bits minus the upper two bits ($a_9$ and $a_8$).

For example, when the image data of 1024 gray levels is "01000000001" (256 of the decimal notation), its converted image data of 1021 gray levels is "01 00000000"-"01" or "0011111111" (255 of the decimal notation).

Also, when the image data of 1024 gray levels is "1000000000" (512 of the decimal notation), its converted image data of 1021 gray levels is "1000000000"-"10" or "0111111110" (510 of the decimal notation).

Moreover, when the image data of 1024 gray levels is "1100000000" (768 of the decimal notation), its converted image data of 1021 gray levels is "1100000000"-"11" or "1011111101", (765 of the decimal notation).

Figures 3, 4:
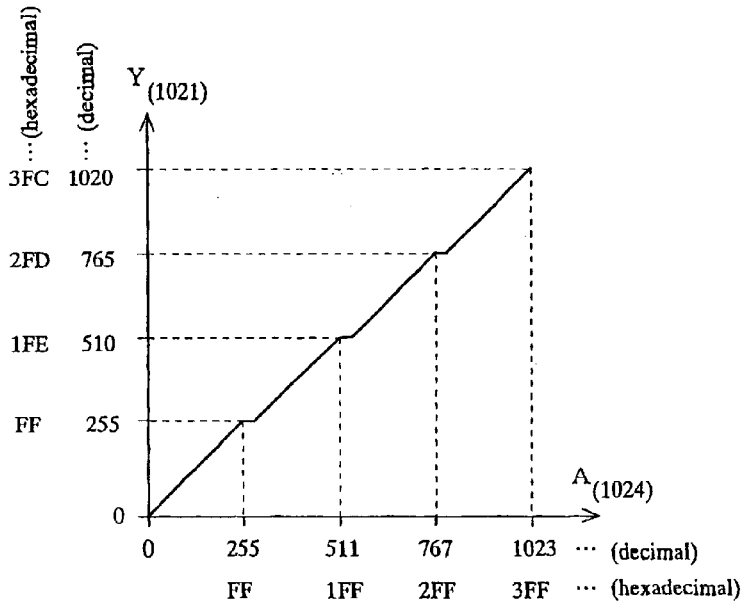
FIG. 3 is a graph showing a profile of the relationship between the image data $A_{(1024)}$ of 1024 gray levels and the image data $Y_{(1021)}$ of 1021 gray levels.
FIG. 4 is a table diagram showing an arrangement of a 256 gray scale conversion image data sample storage.

FIG. 2 illustrates a relationship between the image data of 1024 gray levels and the image data of 1021 gray levels in the form of a table. FIG. 3 is a graphic diagram showing the relationship between the image data of 1024 gray levels and the image data of 1021 gray levels.

As shown, the upper two bits are $a_9=0$ and $a_8=0$ when the 1024 gray scale image data ranging from "0000000000" to "0011111111" (from 0 to 255 of the decimal notation) and thus $a_9\times2^1+a_8\times2^0=0$ is established. Accordingly, the image data of 1021 gray level s is equal to the 1024 gray scale image data minus zero.

The upper two bits are $a_9=0$ and $a_9=1$ when the 1024 gray scale image data ranges from "0100000000" to "0111111111" (from 256 to 511 of the decimal notation) and thus established is $a_9\times2^1+a_8\times2^0=1$. As the result, the image data of 1021 gray levels is equal to the 1024 gray scale image data minus one. The image data of 1021 gray levels is 255 at $A_{(}1024)=256$ (of the decimal notation) and this is equivalent to when the image data of 1024 gray levels s is 255.

Also, the upper two bits are $a_9=1$ and $a_8=0$ when the 1024 gray scale image data ranges from "1000000000" to "1011111111" (from 512 to 767 of the decimal notation) and thus $a_9\times2^1+a_8\times2^0=2$ is established. As the result, the image data of 1021 gray levels is equal to the 1024 gray scale image data minus two. The image data of 1021 gray levels is 510 at $A_{(1024)}=512$ (of the decimal notation and this is equivalent to when the image data of 1024 gray levels is 511.

The upper two bits are $a_9=1$ and $a_8=1$ when the 1024 gray scale image data ranges from "1100000000" to "1111111111" (from 768 to 1023 of the decimal notation) and thus $a_9\times2^1+a_8\times2^0=3$ is established. Accordingly, the image data of 1021 gray levels is equal to the 1024 gray scale image data minus three. The image data of 1021 gray levels is 765 at $A_{(1024)}=768$ (of the decimal notation) and this is equivalent to when the image data of 1024 gray levels is 767.

As described, a specific set of the 1024 gray scale image data to be overlapped when converted into the image data of 1021 gray levels are assigned to three equally spaced figures: 256, 512, and 768 (of the decimal notation). This allows the image to be reproduced at a more natural quality than when the set of the 1024 gray scale image data are converted into a single figure (for example, 1021 to 1023 of 1024 gray levels all converted into 1020 of 1021 gray levels).

FIG. 4 is a table showing an arrangement of the 256 gray scale image data sample storage 2.

The image data $Y_{(1021)}$ of 1021 gray levels stored at the (left) entry column consists of a binary 10-bit value ranging from "0000000000" and "0000000001" to "1111111100" which represent 0 to 1020 (of the decimal notation).

Four groups of the 256 gray scale image data samples stored at the (right) four entry columns are determined by each of four random numbers N (equal to "00", "01", "10", "11") and so that the sum of samples at each group is equal to the image data $D_{(1021)}$ of 1021 gray levels and a difference between the groups is minimum. For example, for "0000000011" of the image data $D_{(1021)}$ of 1021 gray levels, four of the 256 gray scale image data samples are stored including "00000001", "00000001", "00000001", and "00000000".

The random number generator circuit 3 determines a random number N and selects and releases from the 256 gray scale image data sample storage 2 a corresponding set of four different image data samples of 256 gray levels D1 to D4 which correspond to the image data $Y_{(1021)}$ of 1021 gray levels.

The 256 gray scale monochrome liquid crystal display panel 4 displays the four image data D1 to D4 of 256 gray levels in a sequence to speciously reproduce an image of 1021 gray levels.

Figures 9, 10:
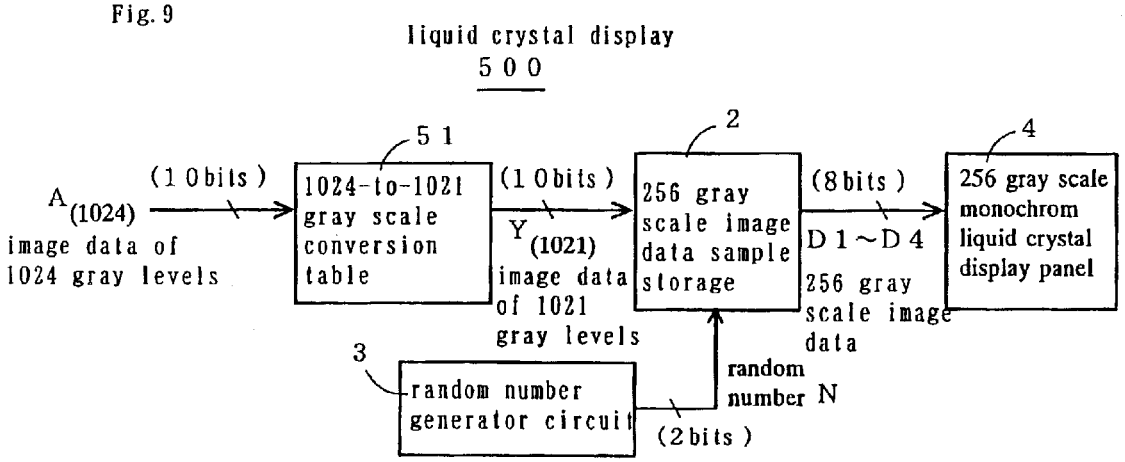
FIG. 9 is a block diagram showing a conventional liquid crystal display apparatus.
FIG. 10 is a table diagram showing a 1024-to-1021 gray scale conversion table in the liquid crystal display apparatus show n in FIG. 9.
Figure 11:
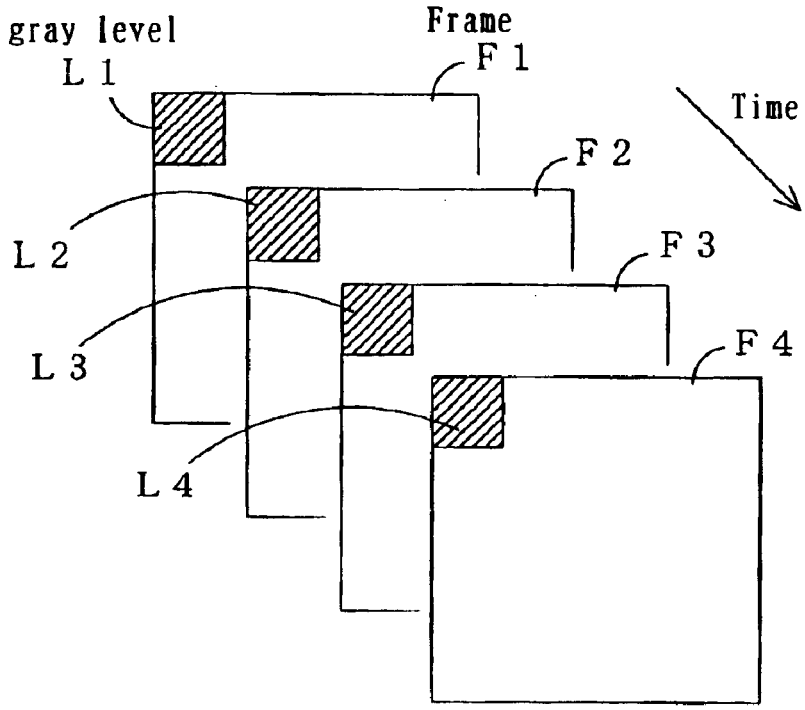
FIG. 11 is an explanatory view showing the principle of interframe error diffusion.

As described, the liquid crystal display 100 of the first embodiment allows its 1024-to-1021 gray scale conversion calculator 1 to perform an arithmetic operation for converting the image data $A_{(1024)}$ of $_{1024}$ gray levels into the image data $Y_{(1021)}$ of 1021 gray levels, thus eliminating the use of a memory which serves as the 1024-to-1021 gray scale conversion table (51 in FIG. 9) and minimizing the overall cost.

Second Embodiment

Figure 5:
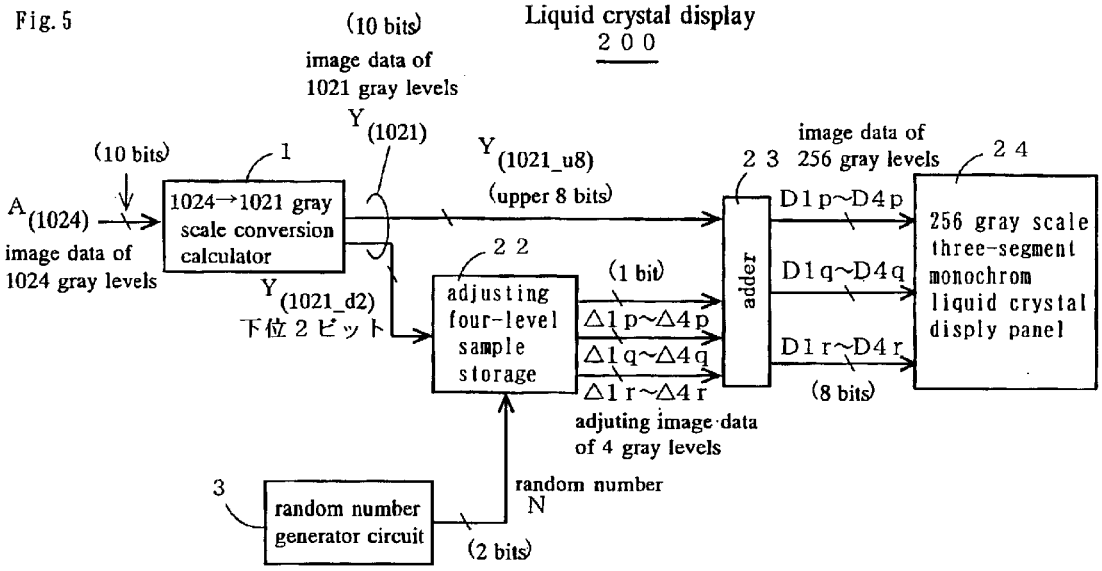
FIG. 5 is a block diagram of a liquid crystal display apparatus showing a second embodiment of the present invention.

FIG. 5 is a block diagram of a liquid crystal display showing the second embodiment of the present invention.

The liquid crystal display 200 comprises a 1024-to-1021 gray scale conversion calculator 1 for converting an image data $A_{(1024)}$ of 1024 gray levels (=10 bits) into an image data $Y_{(1021)}$ of 1021 gray levels, an adjusting four-level sample storage 22 here four groups of four gray level samples determined by the least two bits $Y_{(1021_d2)}$ of the 1021 gray scale image data $Y_{(1021)}$ are stored for each of three segments (p, q, and r in FIG. 6) of one pixel, a random number generator circuit 3 for determining a random number N to select and release at each frame a group of the adjusting four gray levels Δ1p to Δ4p (for the segment p), Δ1q to Δ4q (for the segment q), and Δ1r to Δ4r (for the segment r) which is determined by the least two bits $Y_{(1021_d2)}$ and stored in the adjusting four-level sample storage 22, an adder 23 for summing the upper eight bits of the image data $Y_{(1021)}$ of 1021 gray levels and one group of the adjusting four gray levels Δ1p to Δ4p, Δ1q to Δ4q, and Δ1r to Δ4r of each segment to have three sets of image data of 256 gray levels D1p to D4p (for the segment p), D1q to D4q (for the segment q), and D1r to D4r (for the segment r) which are then released in a sequence, and a 256 gray scale three-segment monochrome liquid crystal display panel 24 for displaying images of 256 gray levels determined by the 256 gray scale image data D1p to D4p, D1q to D4q, and D1r to D4r. The images to be reproduced shall be monochrome images.

Figure 6:
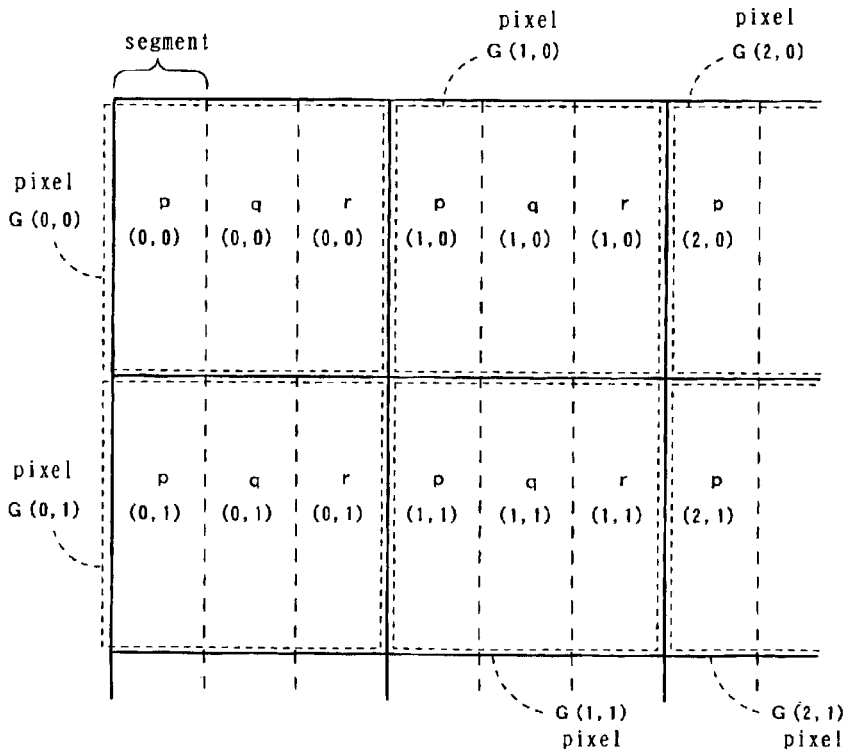
FIG. 6 is an explanatory view of the display screen where each pixel consists of three segments.

As shown in FIG. 6, each pixel G of the 256 gray scale three-segment monochrome liquid crystal display panel 24 consists of the three segments p, q, and r of which the gray level can separately be varied through 256 levels. The monochrome display panel 24 of this type may be implemented by a color liquid crystal display panel with no use of color filters for the three primary colors (red, green, and blue) at each pixel.

FIG. 7 is a diagram showing an arrangement of the adjusting four gray level sample storage 22.

The least two bits $Y_{(1021_d2)}$ stored in the (left) entry column are selected from "00", "01", "10", and "11".

The adjusting four-level samples are stored in the (right) twelve entry columns including a matrix of bits where the number of segments fill ed with is per twelve segments or a total of segments at each pixel of the four frames for interframe error diffusion is equal to the least two bits $Y_{(1021_d2)}/4$ and a difference in the gray level is minimized between the frames. For example, the segments are stored in four patterns of (p,q,r): (1,0,1), (0,1,0), (1,1,0), and (0,0,1), so that when the least two bits $Y_{(1021_d2)}$ are "10" (2 of the decimal notation), the segments filled with 1s are ¾. A desired group of the adjusting four gray levels is determined at every frame from the random number N received from the random number generator circuit 3.

FIG. 8 is a table showing groups of image data of 256 gray levels D1p to D4p, D1q to D4q, and D1r to D4r for the segments p, q, and r which are released at the frame-by-frame basis from the adder 23.

When the image data $Y_{(1021)}$ of 1021 gray levels is expressed by "010000000 0" (256 of the decimal notation), the upper eight bits $Y_{(1021_u8)}$ is "01000000" (64 of the decimal notation) and the least two bits $Y_{(1021_d2)}$ is "00". Then , the adjusting four-level sample storage 22 shown in FIG. 7 releases (p,q,r)=(0,0,0) of the adjusting four gray levels, allowing the image data of 256 gray levels D1p to D4p, D1q to D4q, and D1r to D4r to be 64, 64, and 64 respectively. As the result, an image of 1021 gray levels can speciously be reproduced at the level 256 (=64×4+0).

When the image data $Y_{(1021)}$ of 1021 gray levels is expressed by "0100000001" (257 of the decimal notation), the upper eight bits $Y_{(1021_u8)}$ is "101000000" (64 of the decimal notation) and the least two bits $Y_{(1021_d2)}$ is "0". Then, a group of adjusting four gray levels released from the adjusting four-level sample storage 22 contains three 1s in the twelve segments (a sum of the segments of four pixels) in average although the number of is may be determined by the random number N. Accordingly, an image of 1021 gray levels can speciously be reproduced at the level 257 (=64×4+1)

When the image data $Y_{(1021)}$ of 1021 gray levels is expressed by "0100000010" (258 of the decimal notation), the upper eight bits $Y_{(1021_u8)}$ is "01000000" (64 of the decimal notation) and the least two bits $Y_{(102_d2)}$ is "10". Then, a group of adjusting four gray levels released from the adjusting four-level sample storage 22 contains six 1s in the twelve segments in average although the number of is may be determined by the random number N. Accordingly, an image of 1021 gray levels can speciously be reproduced at the level 258 (=64×4+2).

When the image data $Y_{(1021)}$ of 1021 gray levels is expressed by "0100000011" (259 of the decimal notation), the upper eight bits $Y_{(1021_u8)}$ is "01000000" (64 of the decimal notation) and the least two bits $Y_{(1021_d2)}$ is "11". Then, a group of adjusting four gray levels released from the adjusting four-level sample storage 22 contains nine is in the twelve segments in average although the number of is may be determined by the random number N. Accordingly, an image of 1021 gray levels can speciously be reproduced at the level 259 (=64×4+3).

As described, the liquid crystal display 200 of this embodiment enables the spatial modulation for separately varying the gray level in the three segments of each pixel as well as the chronological modulation (interframe error diffusion) of the gray level between any two consecutive frames, hence declining a difference in the gray level of each pixel between the frames and minimizing the generation of "flicker" and stripe noises in the image. Also, its adjusting four-level sample storage 22 has a storage capacity of as small as 48 bits (=3×4×4) which is far smaller than the storage capacity (1021×8×4 bits) of the 256 gray scale image data sample storage 2 (FIG. 1), thus contributing to the reduction of the overall cost.

Industrial Applicability

The gray scale reducing method of the present invention enables the reduction of the number of gray levels with the use of a simple arithmetic operation, thus eliminating the use of a gray scale conversion table and minimizing the overall cost.

Also, the method and the apparatus for displaying an image of the present invention allows the reproduction of an image of which the number of gray levels is greater than that of a display panel to be implemented speciously but explicitly.

The present invention is particularly advantageous by converting the monochrome image data of 1024 gray levels into image data of 1021 gray levels and speciously reproducing a monochrome image of 1021 gray levels with the use of four frames of image data of 256 gray levels.

What is claimed is:

1. A gray scale reducing method comprising a step of:

converting a bit stream A ($a_{\alpha-1}$, $a_{\alpha-2}$, $a_{\alpha-3}$, . . . $a_0$) of $2^\alpha$ gray levels expressed by input of the bit stream $A=a_{\alpha-1}\times2^{\alpha-1}+a_{\alpha-2}\times2^{\alpha-2}+a_{\alpha-3}\times2^{\alpha-3}+\ldots+a_0\times2^0$ into a bit stream of $(2^\alpha-2^{\alpha-\beta}+1)$ gray levels expressed by output bit stream $Y=a_{\alpha-1}\times2^{\alpha-1}+a_{\alpha-2}\times2^{\alpha-2}+a_{\alpha-3}\times2^{\alpha-3}+\ldots+a_0\times2^0-(a_{\alpha-1}\times2^{\alpha-\beta-1}+a_{\alpha-2}\times2^{\alpha--2}+\ldots+a_\beta\times2^0)$ wherein $\alpha$ is a number of bits in the bit stream A and $\alpha$ is $\geqq2$, and wherein $\beta$ is a number of bits by which the bit stream A is right-shifted and $\alpha>\beta\geqq1$.

2. An image displaying method comprising steps of:

converting an image data by the gray scale reducing method defined in claim 1 from a bit stream of $2^\alpha$ gray levels to a bit stream of $2^\alpha-2^{\alpha-\beta}+1)$ gray levels; and speciously reproducing by interframe error diffusion an image of which the gray level is equal to that of the converted bit stream.

3. An image displaying apparatus comprising:

a gray scale reducing means for converting a bit stream A ($a_{\alpha-1}$, $a_{\alpha-2}$, $a_{\alpha-3}$, . . . , $a^0$) of $2^\alpha$ gray levels expressed by input of the bit stream $A=a_{\alpha-1}\times2^{\alpha-1}+a_{\alpha-2}\times2^{\alpha-2}+a_{\alpha-3}\times2^{\alpha-3}+\ldots+a_0\times2^0$ into a bit stream of $(2^\alpha-2^{\alpha-\beta}+1)$ gray levels expressed by output bit stream $Y=a_{\alpha-1}\times2^{\alpha-1}+a_{\alpha-2}\times2^{\alpha-2}+a_{\alpha-3}\times2^{\alpha-3}+\ldots+a_0\times2^0-(a_{\alpha-1}\times2^{\alpha-\beta-1}+a_{\alpha-2}\times2^{\alpha-\beta-2}+\ldots+a_\beta\times2^0)$ wherein $\alpha$ is a number of bits in the bit stream A and $\alpha$ is >2, and wherein $\beta$ is a number of bits by which the bit stream A is right-shifted and $\alpha>\beta\geqq1$;

a displaying panel of which the number of gray levels for reproducing each frame of the image on a pixel-by-pixel basis is smaller than $2^\alpha$; and an image display controlling means for displaying on the display panel a series of images which have speciously been reproduced by interframe error diffusion and have speciously been reproduced by interframe error diffusion and have corresponding gray levels determined by the converted bit streams.

4. An image displaying apparatus comprising:

a gray scale reducing means for converting a bit stream A ($a_{\alpha-1}$, $a_{\alpha-2}$, $a_{\alpha-3}$, . . . , $a_0$) of $2^\alpha$ gray levels expressed by input of the bit stream $A=a_{\alpha-1}\times2^{\alpha-1}+a_{\alpha-2}\times2^{\alpha-2}+a_{\alpha-3}\times2^{\alpha-3}+\ldots+a_0\times2^0$ into a bit stream of $(2^\alpha-2^{\alpha-\beta}+1)$ gray levels expressed by output bit stream $Y=a_{\alpha-1}\times2^{\alpha-1}+a_{\alpha-2}\times2^{\alpha-2}+a_{\alpha-3}\times2^{\alpha-3}+\ldots+a_0\times2^0-(a_{\alpha-1}\times2^{\alpha-\beta-1}+a_{\alpha-2}\times2^{\alpha-\beta-2}+\ldots+a_\beta\times2^0)$ wherein $\alpha$ is a number of bits in the bit stream A and $\alpha$ is $\geqq2$, and wherein $\beta$ is a number of bits by which the bit stream A is right-shifted and $\alpha>\beta\geqq1$;

a displaying panel for reproducing $2^\beta$ gray levels in each of m segments ($m\geqq2$) of one pixel;

a gray level calculating means for summing the upper $\beta$ bits of the converted bit stream and an adjusting gray level predetermined for each segment by the lower $(\alpha-\beta)$ bits of the bit stream to determine the gray level in the segment at each of the frames to be subjected to interframe error diffusion; and an image display controlling means for controlling the gray level in the segment of the display panel on the frame-by-frame basis.

5. An image displaying apparatus according to claim 4, further comprising:

an adjusting gray level sample storing means for saving samples of the adjusting gray level predetermined and assigned to each segment so that the average of gray levels of each pixel at the $2^{\alpha-\beta}$ frames for the error diffusion calculated by the gray scale reducing means is the upper $\beta$ bits plus the least $(\alpha-\beta)$ bits/$2^{\alpha-\beta}$; and a randomly selecting and releasing means for randomly selecting and releasing any of the samples of the adjusting gray level on the frame-by-frame basis.

6. An image displaying apparatus according to any one of claim 3, 4 or 5, wherein the displaying panel is a monochrome liquid crystal display panel.

* * * * *